US010398230B2

(12) United States Patent
Ma

(10) Patent No.: US 10,398,230 B2
(45) Date of Patent: Sep. 3, 2019

(54) CHAIR FRAME WITH HIGH STRENGTH AND HIGH STABILITY

(71) Applicant: TAIZHOU LUCKY PRETTY MACHINERY Co., Ltd., Taizhou (CN)

(72) Inventor: Mingyang Ma, Taizhou (CN)

(73) Assignee: TAIZHOU LUCKY PRETTY MACHINERY CO., LTD., Taizhou (CN)

( * ) Notice: Subject to any disclaimer, the term of this patent is extended or adjusted under 35 U.S.C. 154(b) by 73 days.

(21) Appl. No.: 15/851,748

(22) Filed: Dec. 22, 2017

(65) Prior Publication Data

US 2018/0263371 A1 Sep. 20, 2018

(30) Foreign Application Priority Data

Mar. 20, 2017 (CN) ..... 2017 1 0163916

(51) Int. Cl.
*A47C 1/024* (2006.01)
*A61G 5/14* (2006.01)
*A47C 5/04* (2006.01)

(52) U.S. Cl.
CPC ..... *A47C 1/0242* (2013.01); *A47C 5/04* (2013.01); *A61G 5/14* (2013.01)

(58) Field of Classification Search
CPC . A47C 1/0242; A47C 1/03211; A47C 1/0342; A61G 5/14
See application file for complete search history.

(56) References Cited

U.S. PATENT DOCUMENTS 5,651,580 A * 7/1997 LaPointe ..... A47C 1/0355 297/325
6,000,758 A * 12/1999 Schaffner ..... A47C 1/0345 297/180.12
6,840,575 B2 * 1/2005 Hesse ..... A47C 1/0355 297/75
7,543,885 B2 * 6/2009 Pollard ..... A47C 1/0355 297/85 R
7,673,933 B2 * 3/2010 Lawson ..... A47C 1/0345 297/69
7,766,421 B2 * 8/2010 Lawson ..... A47C 1/0355 297/84

(Continued)

FOREIGN PATENT DOCUMENTS

WO WO-2015184596 A1 * 12/2015 ..... A61G 5/14

*Primary Examiner* — Timothy J Brindley
(74) *Attorney, Agent, or Firm* — Gokalp Bayramoglu

(57) ABSTRACT

This invention provides a chair frame with high strength and high stability, including a base front supporting tube, a base rear supporting tube, a base right supporting tube and a base left supporting tube. A pedal support is connected to a front driving tube through a connecting rod mechanism. Two ends of a main motor telescopic rod mechanism are respectively fixed to the front driving tube and the base rear supporting tube. Two ends of a backrest motor telescopic rod mechanism are fixedly connected to a backrest front driving tube and a backrest rear driving tube. An upper frame is fixedly connected to a connecting piece thereof. The base right supporting tube and the base left supporting tube are fixedly connected to a connecting piece thereof. Two sides of the front driving tube are further connected to a clamping piece.

12 Claims, 6 Drawing Sheets

(56) References Cited

U.S. PATENT DOCUMENTS

| | | | | |
|---|---|---|---|---|
| 9,743,770 | B1 * | 8/2017 | Pollard | A47C 1/0355 |
| 2002/0101102 | A1 * | 8/2002 | Chang | A61G 5/14 297/330 |
| 2011/0291460 | A1 * | 12/2011 | Murphy | A61G 5/14 297/85 M |
| 2015/0076891 | A1 * | 3/2015 | LaPointe | A47C 31/008 297/85 M |
| 2016/0346143 | A1 * | 12/2016 | White | A61G 5/14 |
| 2018/0161223 | A1 * | 6/2018 | Murphy | A47C 1/0355 |
| 2018/0228290 | A1 * | 8/2018 | Kiwak | A47C 1/0352 |

* cited by examiner

CHAIR FRAME WITH HIGH STRENGTH AND HIGH STABILITY

CROSS REFERENCE TO RELATED APPLICATIONS

This application is based upon and claims priority to Chinese Patent Application No. CN2017101639162, filed on Mar. 20, 2017, the entire content of which is incorporated herein by reference.

TECHNICAL FIELD

The invention relates to the technical field of mechanical design, particularly to a chair frame with high strength and high stability.

BACKGROUND OF THE INVENTION

The multifunctional chair can be unfolded as a reclining chair or a massage chair, and the multifunctional chair can also move up and down as a general office or household seat after being retracted, so that a plurality of use requirements can be brought to people, and therefore, the method is popular among a great number of users. The chair frame of the multifunctional chair generally includes a seat part and a pedal part which can be unfolded or retracted. A motor telescopic rod mechanism and a plurality of connecting rod structures are installed below the chair frame of the seat part to realize unfolding and retracting of the pedal part of the multifunctional chair, and upward and downward movements of the seat.

Referring to the existing chair frame used for manufacturing the multifunctional chair as shown in FIG. 1, the chair frame includes a base 10, wherein the base 10 includes a base front supporting tube 12 and a base rear supporting tube 14, a base right supporting tube 16 and a base left supporting tube 18 (see FIG. 4). The pair of pedal supports 42 is connected to the front driving tube 40 through a connecting rod mechanism, and one end of the main motor telescopic rod mechanism 50 is fixedly connected to the front driving tube 40, and the other end of the main motor telescopic rod mechanism 50 is fixedly connected with the base rear supporting tube 14. The left handrail support 36 and the right handrail support 36 are connected and fixed to the two ends of the backrest front driving tube 34, the front driving tube 34 is connected to the front driving tube 40 through a connecting rod mechanism, and one end of the backrest motor telescopic rod mechanism 60 is fixedly connected to the backrest front driving tube 34, and the other end of the backrest motor telescopic rod mechanism 60 is fixedly connected to the backrest driving tube 32. The front end of the upper frame 20 is fixedly welded to the upper portion of the connecting piece 26, and the front end of the lower frame 30 is connected to the lower portion of the connecting piece 26 through rivets.

As to the multifunctional chair made of the chair frame, the front driving tube 40 which is fixedly connected to the main motor telescopic rod mechanism 50 is driven by the main motor telescopic rod mechanism 50, and then the pedals can be stretched out and unfolded through a connecting rod mechanism between the front driving tube 40 and the pedal supports 42. When the user is sitting on the chair upright, generally there is no big problem. However, in many cases, the user can sit close to one side of the chair, even sometimes, the user can directly sit on one side of the pedal (the position pointed to by two arrows in FIG. 1). In this case, the weight of the user body is transmitted to one side of the front driving tube 40 through the connecting rod mechanism. On one hand, the connecting rod mechanism is always connected in a riveting mode, and when too large force is applied to the connecting rod mechanism, the seat tends to be unstable. The deformation of the connecting rod mechanism can be caused after a long period making the seat more unstable. The front driving tube 40 is fixedly connected to the main motor telescopic rod mechanism 50, and the weight of the heavy body can be directly transmitted to the motor telescopic rod. The deformation and bending of the motor telescopic rod can be caused after a long period, thus hindering the stretching and upward and downward movements of the seat, impacting the use by the user. Furthermore, when the weight of the user is too large, it may cause the telescopic rod of the motor to break, so that the seat loses the corresponding functions. These cause quality defects of the product and even damages to the user.

In addition, on an existing chair frame, referring to an amplifying portion of FIG. 1, the connecting mode between the upper frame 20 and the connecting piece 26 is as follows. Firstly, the upper frame 20 of the square tube structure is primarily fixed between the two connecting plates 2601 of the connecting piece 26 through two rivets 206. Next, the top surface of the upper frame and the top of the connecting plate 2061 are aligned and then welded. The edges of the upper frame adjacent to the connecting piece are wholly welded. This connecting and fixing mode has several problems. First, the upper frame 20 and the connecting piece 26 are pre-fixed by two rivets which are horizontally arranged when the upper frame 20 and the connecting piece 26 are primarily positioned. Due to the fact that all the components which are matched with each other unavoidably have the size tolerances, the top surface of the upper frame 20 and the connecting plate 2601 cannot be completely aligned during welding, which increases the difficulty in welding. It is difficult to ensure that the two connecting plates 2601 can be accurately positioned with the upper frame 20, which easily results in a poor welding quality and being scrapped. Further, in order to ensure the connection strength between the upper frame 20 and the two connecting plates 2601 of the connecting piece 26, and avoid the deformation caused after the seat is used for a long time, in the prior art, an integral welding mode of the adjacent edges is adopted, so that the workload of welding is also increased. Similarly, the rear end of the base right supporting tube 16 and the rear end of the base left supporting tube 18 are connected to the connecting piece 25, which has similar connection issues.

Therefore, in view of the problems existing in the prior art, the multifunctional seat frame needs to be improved to improve the stability and the load bearing strength of the seat and reduce difficulty in machining.

SUMMARY OF THE INVENTION

According to the problems in the prior art, the invention aims to provide an improved multifunctional chair frame, so that the difficulty in machining of the chair frame can be reduced while the improved multifunctional chair frame has a high stability and an excellent load bearing strength.

To achieve the objectives of the invention, the invention provides a chair frame having a high stability and a high load bearing strength, including a base, wherein the base includes a base front supporting tube, a base rear supporting tube, a base right supporting tube and a base left supporting tube, a pedal support is connected to a front driving tube through a connecting rod mechanism, one end of a main motor telescopic rod mechanism is fixedly connected to the front driving tube, and the other end of the main motor telescopic rod mechanism is fixedly connected to the base rear supporting tube; a left handrail support and a right handrail support are fixed to a left end of a backrest front driving tube and a right end of the backrest front driving tube, and the backrest front driving tube is connected to the front driving tube through a connecting rod mechanism, one end of a backrest motor telescopic rod mechanism is fixedly connected to the backrest front driving tube, and the other end of the backrest motor telescopic rod mechanism is fixedly connected to a backrest rear driving tube; a front end of an upper frame is fixedly connected to an upper portion of a connecting piece, and a front end of a lower frame is connected to a lower portion of the connecting piece through a rivet, and a rear end of the lower frame is connected to a connecting piece through a rivet, a rear end of the base left supporting tube and a rear end of the base right supporting tube are fixedly connected to a lower portion of the connecting piece, each of two sides of the front driving tube is further connected to a clamping piece, and a clamping pin structure matched with the clamping piece is fixed on the upper frame.

Preferably, the clamping piece includes a square hole connected to the front driving tube in a sleeved mode, a first clamping portion, and a second clamping portion opposite to the first clamping portion, wherein the clamping pin structure includes a fixing portion fixed to the upper frame, and a pin shaft matched with the first clamping portion of the clamping piece.

Preferably, the clamping pin structure further includes a limiting portion, and the pin shaft is arranged between the fixing portion and the limiting portion.

Preferably, a point where the clamping piece connects to the clamping pin structure is not in the same plane as the connecting rod mechanism on two sides of the chair frame.

Preferably, the clamping piece is installed on the front driving tube through the square hole and is welded and fixed to the front driving tube.

Preferably, a clamping pin is arranged on the first connecting piece of the upper frame, after the pedal support of the chair frame is retracted, the second clamping portion of the clamping piece abuts against the clamping pin.

Preferably, a connecting rivet is arranged in the middle of two connecting plates of the connecting piece of the upper frame, and the connecting rivet is not in the same plane as a rivet connected between the upper frame and the connecting piece.

Preferably, a connecting rivet is arranged in the middle of two connecting plates of the connecting piece of the base left supporting tube or the base right supporting tube, and the connecting rivet is not in the same plane as a rivet connected between the base left supporting tube or the base right supporting tube and the connecting piece.

Preferably, the upper frame is fixed to the connecting piece by spot welding.

Preferably, the base left supporting tube or the base right supporting tube is fixed to the connecting piece by spot welding.

As to the chair frame having a high strength and high stability, a set of clamping pin connecting structures are additionally arranged between each of two ends of the front driving tube and the upper frame. The clamping pin connecting structures, the upper frame of the chair frame, the base left supporting tube, the base right supporting tube, and the connecting rod mechanism are not in the same plane and a three-point fixed pressure-bearing structure in the space is formed. When a user sits on the chair, and the weight of the body can be transmitted to the chair frame base through the pressure-bearing structure firstly, and the extra weight can be transmitted to a pressure bearing structure of the motor telescopic rod mechanism, so that weight supporting capability of the seat is greatly increased, the stability of the seat is improved, and the motor telescopic rod mechanism is effectively protected. The connecting structure between the upper frame and the fixed connecting piece of the upper frame, and the connecting structure between the left and right supporting tubes of the chair frame and the fixed connecting piece are improved and designed, which improves the precision of welding fixation, and the load bearing strength and stability of the connection structure.

BRIEF DESCRIPTION OF THE DRAWINGS

The foregoing and other objectives, features, and advantages of the present invention will become apparent, from the following detailed description with reference to the accompanying drawings, in which.

Figure 1:
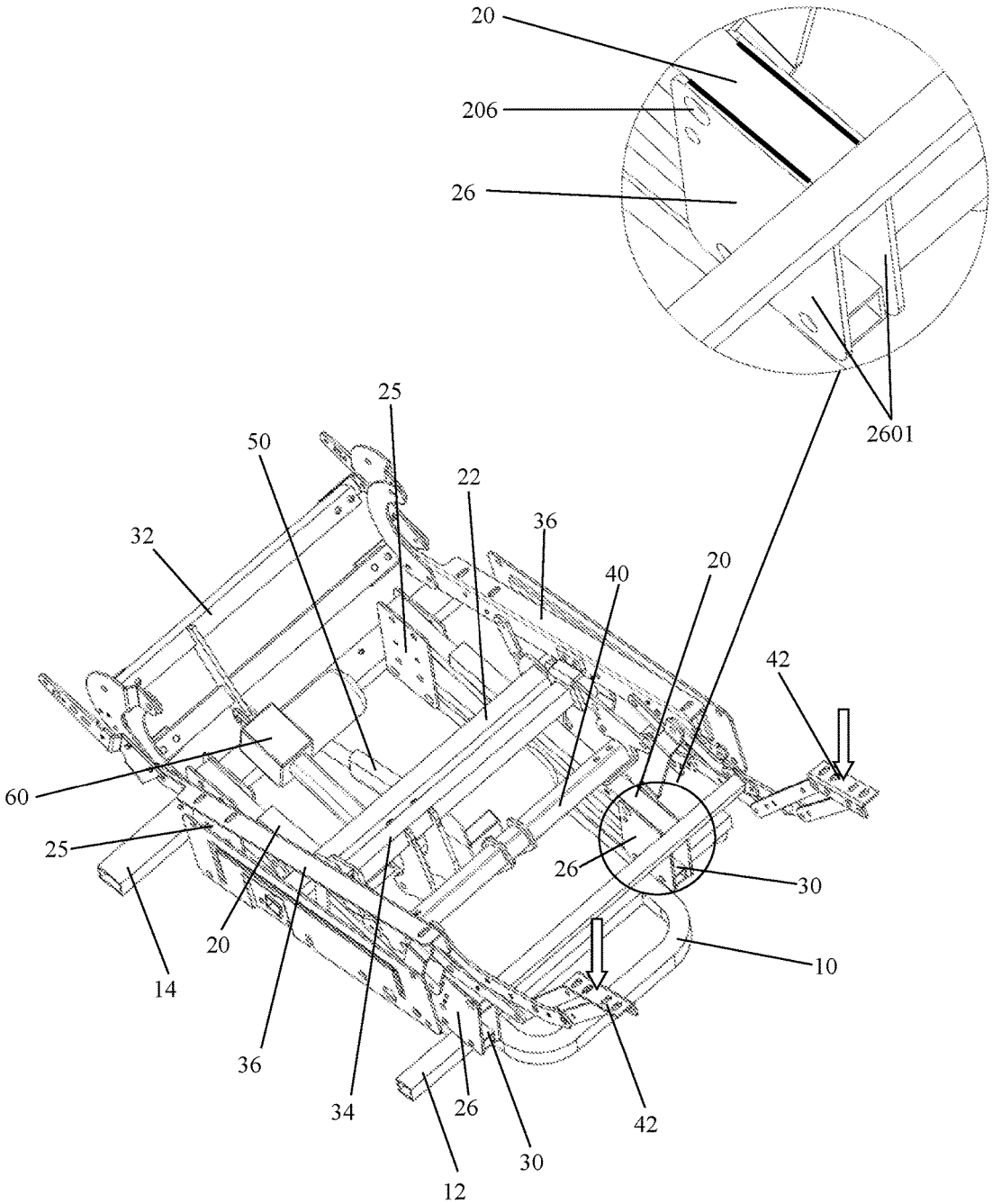
FIG. 1 is a schematic structural diagram of a chair frame used for a multifunctional seat in the prior art.

Reference numbers and names of the parts in the drawings are as follows:

10—base; 12—base front supporting tube; 14—base rear supporting tube 16—base left supporting tube; 18—base right supporting tube; 20—upper frame 25 (25')—lower frame connecting piece; 26 (26')—upper frame connecting piece 261—clamping pin; 30—lower frame; 32—backrest rear driving tube; 34—backrest front driving tube; 36—handrail support; 40—front driving tube; 41—front driving tube fixing connecting block; 42—pedal support; 44—clamping piece; 441—square hole; 443—first clamping portion; 445—second clamping portion; 46—clamping pin structure 461—fixing portion; 463—pin shaft; 465—limiting portion; 50—main motor telescopic rod mechanism; 60—backrest motor telescopic rod mechanism

DETAILED DESCRIPTION OF THE INVENTION

The structural features and advantages of the present invention are described in detail with reference to the drawings.

Figure 2:
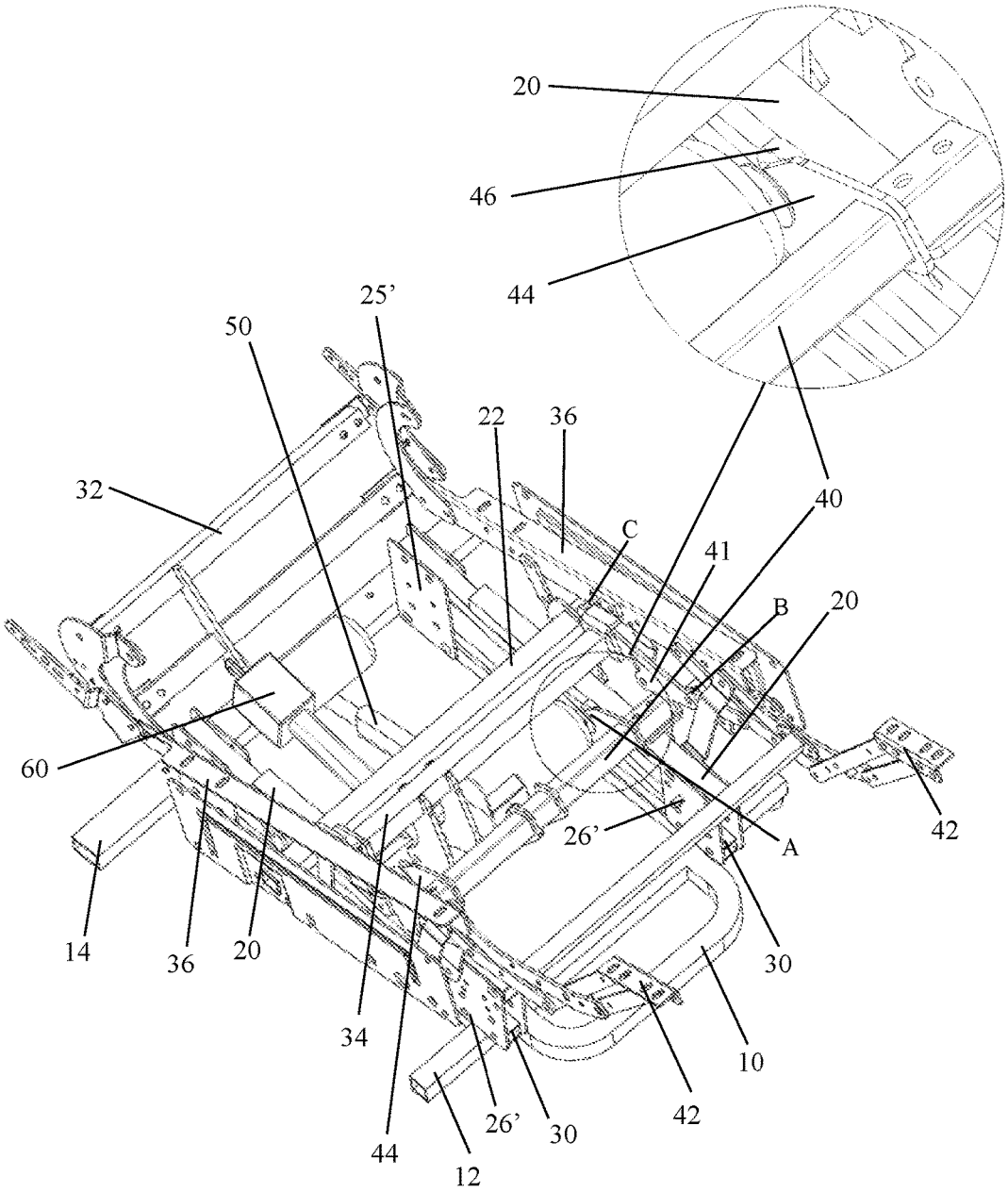
FIG. 2 is a schematic structural diagram of a chair frame used for a multifunctional seat according to an embodiment of the invention.
Figure 3A:
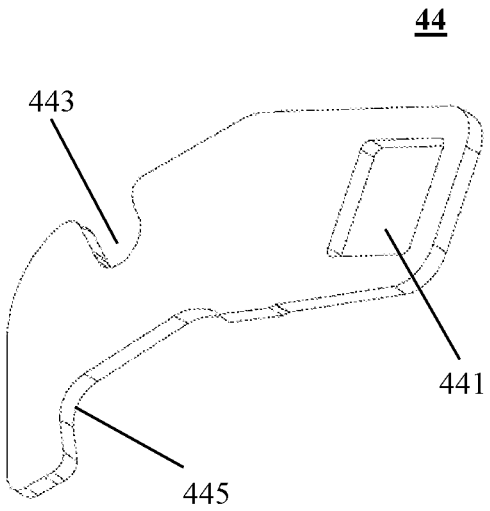
FIG. 3A is a schematic structural diagram of a clamping piece fixed to a front driving tube in the chair frame of FIG. 2.
Figure 3B:
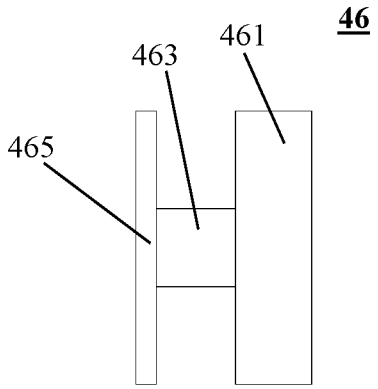
FIG. 3B is a structural schematic diagram of a clamping pin structure matched with the clamping piece of FIG. 3A in the chair frame of FIG. 2.
Figure 4:
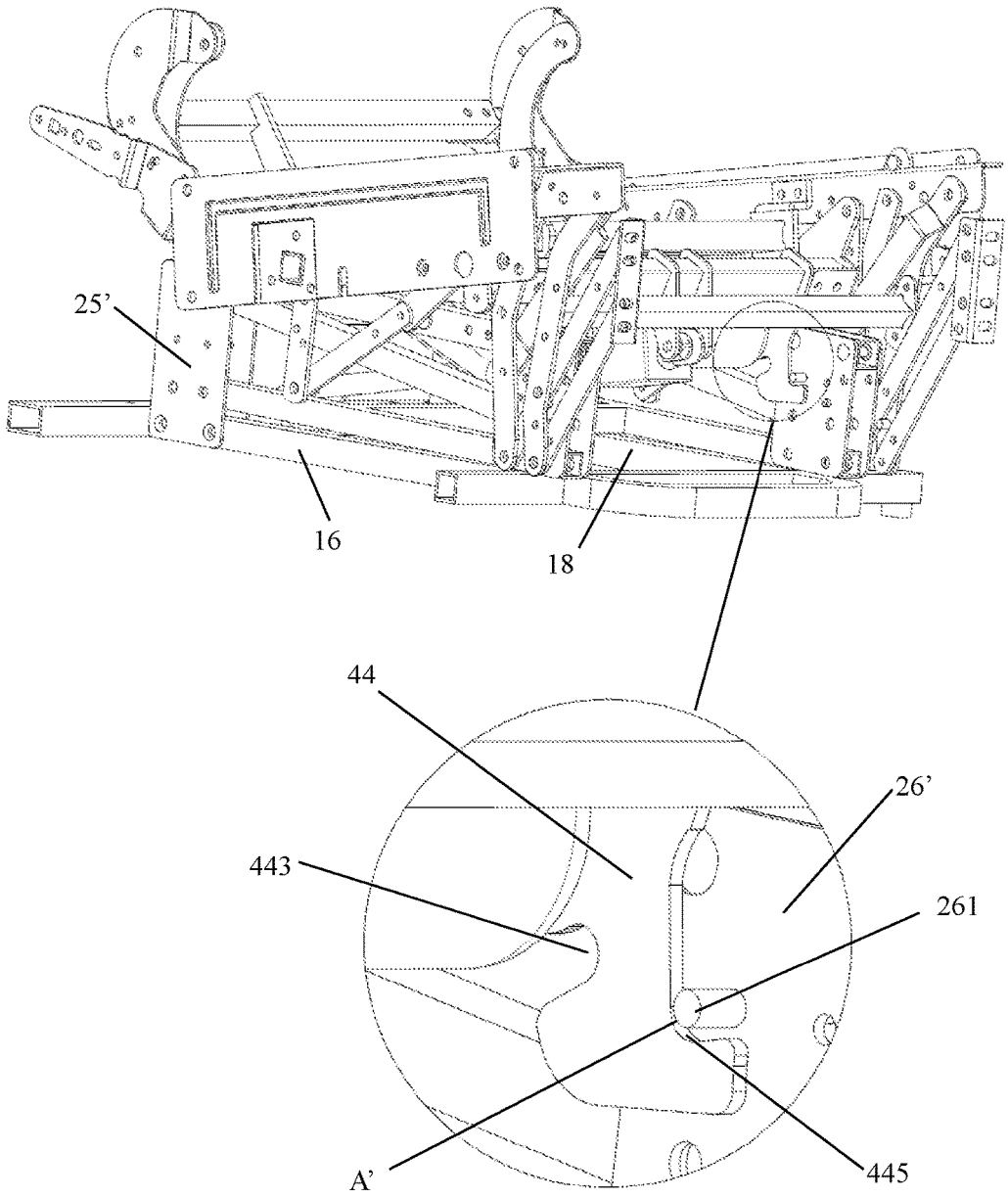
FIG. 4 is a schematic diagram of the state of the retracted pedal support of the chair frame in FIG. 2.

Referring to FIG. 2, a structural diagram of a chair frame for a multifunctional seat according to an embodiment of the present invention is shown, wherein the chair frame includes a base 10. The base 10 includes a base front supporting tube 12 and a base rear supporting tube 14, a base right supporting tube 16 and a base left supporting tube 18 (see FIG. 4). A pair of pedal supports is connected to the front driving tube 40 through a connecting rod mechanism. One end of the main motor telescopic rod mechanism 50 is fixedly connected to the front driving tube 40, and the other end of the main motor telescopic rod mechanism 50 is fixedly connected to the base rear supporting tube 14. The left handrail support 36 and the right handrail support 36 are connected and fixed to the left end and the right end of the backrest front driving tube 34, and the backrest front driving tube 34 is connected to the front driving tube 40 through a connecting rod mechanism. One end of the backrest motor telescopic rod mechanism 60 is fixedly connected to the backrest front driving tube 34, and the other end of the backrest motor telescopic rod mechanism 60is fixedly connected to the backrest rear driving tube 32. The front end of the upper frame 20 is fixedly connected to the upper portion of the connecting piece 26', and the front end of the lower frame 30 is connected to the lower portion of the connecting piece 26' through rivets, and the rear end of the lower frame 30 is connected to the connecting piece 25' through rivets. The rear end of the base right supporting tube 16 and the rear end of the base left supporting tube 18 are fixedly connected to the lower portions of the connecting pieces 25'. The two sides of the front driving tube 40 are further connected to clamping pieces 44, and clamping pin structures 46 matched with the clamping pieces 44 are fixed on the upper frame 20. Referring to FIG. 3A, each clamping piece 44 includes a square hole 441 connected to the front driving tube 40 in a sleeved mode, a first clamping portion 443 and a second clamping portion 445 opposite to the first clamping portion 443. The clamping piece 44 is installed on the front driving tube 40 through the square hole 441 and then is welded and fixed to the front driving tube 40. Each clamping pin structure 46 includes a fixing portion 461 fixed to the upper frame, a pin shaft 463 matched with the first clamping portion 443 of the clamping piece 44, and a limiting portion 465. The pin shaft 463 is arranged between the fixing portion 461 and the limiting portion 465. Referring to FIG. 4, the clamping pin 261 matched with the second clamping portion 445 of the clamping piece 44 is provided on the connecting piece 26'.

As shown in FIG. 2, when the pedal supports 42 of the chair frame is driven by the main motor telescopic rod mechanism 50 to stretch forward to a position through the front driving tube 40 and the connecting rod mechanism. The first clamping portion 443 of the clamping piece 44 arranged on the front driving tube 40 abuts against the pin shaft 463 of the clamping pin structure 46 fixed on the upper frame. In this case, when a user sits on the seat, the applied weight of body is transmitted to the upper frame 20 through the combination of the clamping piece 44 and the clamping pin structure 46, and then is transmitted to the base right (left) supporting tube through the fixed connecting piece 46' of the upper frame 20, wherein the connecting piece 46' contacts the base right (left) supporting tube. The base supporting tube is arranged on the ground, so that the clamping piece 44 and the clamping pin structure 46 are additionally arranged to additionally add a pressure-bearing structure for the chair frame, and thus the bearing weight of the chair frame is increased. In addition, in order to ensure the use effect of the pressure-bearing structure, in the design of the matching structure of the first clamping portion 443 of the clamping piece 44 and the pin shaft 463, when the pedal supports 42 extend to the position, a certain gap is reserved between the pin shaft 463 and the bottommost portion of the first clamping portion 443. At this time, the pin shaft 463 abuts against the side edge of the first clamping portion 443 to form a pressure bearing mechanism. When the bearing weight on the seat exceeds a certain value, the pin shaft 463 can be completely and tightly matched with the first clamping portion 443. At the moment, the extra weight of the body on the seat can be transmitted to the telescopic rod of the main motor telescopic rod mechanism 50 fixed to the front driving tube 40, and then is transmitted to a base rear supporting tube 14 fixed to the other end of the main motor telescopic rod mechanism 50. Therefore, by means of the design, on one hand, the weight bearing capacity of the chair frame is increased; and on the other hand, the main motor telescopic rod mechanism 50 is effectively protected, so that the main motor telescopic rod mechanism 50 would not be deformed and even damaged due to overload, and thus the quality of the chair frame and the service life of the chair frame are guaranteed. In addition, in order to ensure the stability of the chair frame, the clamping piece 44 is arranged on the front driving tube 40 and is located at a certain distance away from upper frame 20 and the plane where the base left supporting tube and the base right supporting tube are located. In this way, a contact point A where the clamping piece 44 abuts against the clamping pin structure 46, a fixing point B where a fixed connecting block 41 on the end portion of the front driving tube 40 is connected to the connecting rod mechanism, and a fixed connecting point C where the connecting rod mechanism is connected to the handrail support 36 forms a three-point fixed supporting structure in a space, to provide a very stable space pressure-bearing structure. Therefore, the weight bearing capacity of the chair frame is guaranteed, and even when the user sits close to one side of the seat, namely, the body weight of the user is almost completely applied to one side of the chair frame, the stability of the seat can also be guaranteed.

Referring to FIG. 4, a clamping pin 261 is arranged on the connecting piece 26' of the upper frame. When the pedal support 42 of the chair frame is driven by the main motor telescopic rod mechanism 50 to be retracted through the front driving tube 40 and the connecting rod mechanism, the second clamping portion 445 of the clamping piece 44 abuts against the clamping pin 261. In this case, the three-point fixed supporting structure formed in the new three-dimensional space by including the point where the second clamping portion 445 abuts against the clamping pin 261 works. When the user sits on the seat, the applied weight of body is transmitted to the upper frame 20 through the combination of the clamping piece 44 and the clamping pin 261, and then is transmitted to the base right (left) supporting tube through the fixed connecting piece 46' of the upper frame 20, wherein the fixed connecting piece 46' contacts the base right (left) supporting tube. The weight bearing capability of the chair frame is increased and the weight bearing capability of the seat after the pedal is retracted is guaranteed by this new additional pressure-bearing structure. Similarly, in the design of the matching structure of the second clamping portion 445 of the clamping piece 44 and the clamping pin 261, after the pedal support 42 is retracted, and a certain gap is reserved between the clamping pin 261 and the bottommost portion of the second clamping portion 445. Only when the weight of the body on the seat exceeds a certain value, the clamping pin 261 and the second clamping portion 445 can be completely and tightly matched. At the moment, the extra weight of the body on the seat can be transmitted to the main motor telescopic rod mechanism 50 fixed to the front driving tube 40, and then is transmitted to the base rear support tube 14 fixed to the other end of the main motor telescopic rod mechanism 50. In this way, through the design, on one hand, the bearing weight of the chair frame is increased; and on the other hand, the main motor telescopic rod mechanism 50 is effectively protected. Similarly, since the clamping piece 44 is arranged on the front driving tube 40, and is located at a certain distance away from upper frame 20 and the plane where the base left supporting tube and the base right supporting tube are located, in this way, the connection structure of the clamping piece 44 and the clamping pin 261 forms a new three-point fixed supporting structure in the space to provide a very stable space pressure-bearing structure. Therefore, the weight bearing capability of the chair frame is guaranteed, and even when the user sits close to one side of the seat, namely, the body weight of the user is almost completely applied to one side of the chair frame, and the stability of the seat can also be guaranteed.

Figure 5:
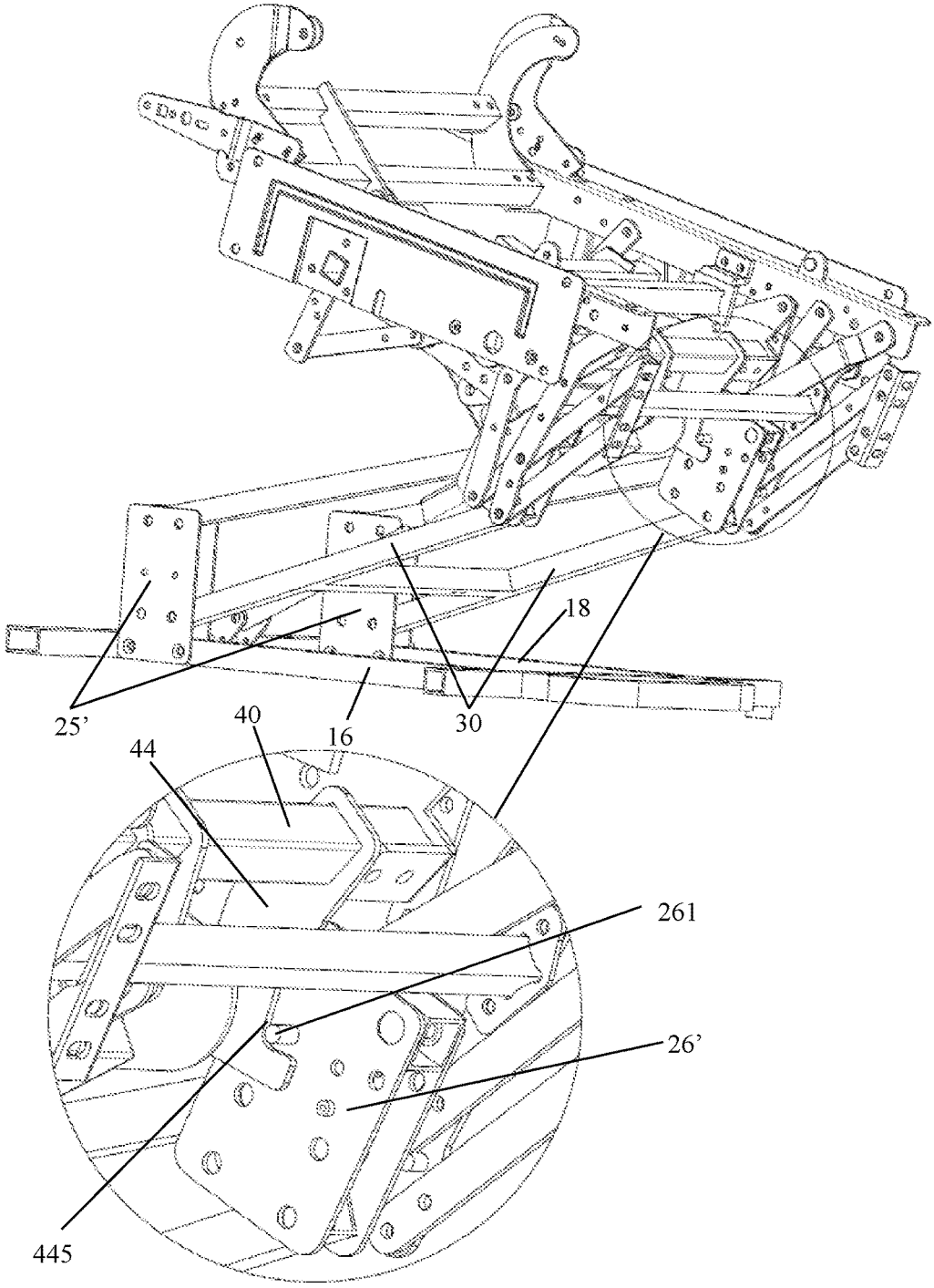
FIG. 5 is a schematic diagram of a state after the chair frames of FIG. 2 is lifted.

According to the state diagram of the lifted chair frame shown in FIG. 5, after the chair frame is lifted to a preset position, the second clamping portion 445 of the clamping piece 44 is in abutting connection with the clamping pin 261. In this case, like FIG. 4, a new three-point fixed supporting structure formed in a three-dimensional space by including a point where the second clamping portion 445 abuts the clamping pin 261 works. When the user sits on the seat, the applied weight of the body is transmitted to the upper frame 20 through the combination of the clamping piece 44 and the clamping pin 261, and then is transmitted to the lower frame 30 through the fixed connecting piece 46' of the upper frame 20, wherein the lower frame 30 contacts the fixed connecting piece 46'. The other end of the lower frame 30 is connected to the lower frame connecting piece 25', and the lower frame connecting piece 25' is connected to the base right (left) supporting tube 16 (18), so that the weight of the body is transmitted to the base of the chair frame through the additional pressure-bearing structure. Hence, the weight bearing capability of the chair frame is increased, and effective protection is formed for the motor telescopic rod mechanism. Similarly, the clamping piece 44 is arranged on the front driving tube 40 and is located between the upper frame 20 and the base, the left supporting tube and the right supporting tube are located at a certain distance, the connecting structure of the clamping piece 44 and the clamping pin 261 is matched with that of the upper frame 40 and the left of the base, the left supporting tube and the right supporting tube also form a three-point fixed supporting structure in a new space, and a very stable space pressure-bearing structure can be provided. Therefore, the weight bearing capability of the chair frame is guaranteed, and even when the user sits close to one side of the seat, namely the body weight of the user is almost completely applied to one side of the chair frame, the stability of the seat can also be ensured.

Figure 6:
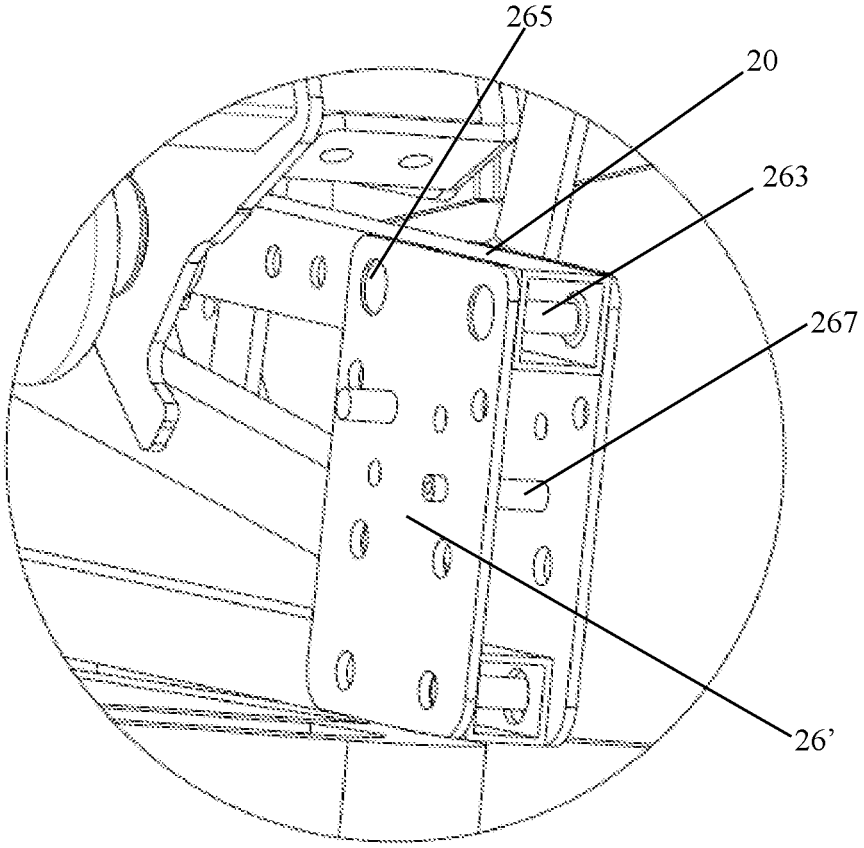
FIG. 6 is a structural schematic diagram of a connecting piece which is fixedly connected to an upper frame in the chair frame of FIG. 2.

Referring to FIG. 6, as to the chair frame of the multi-functional seat of the invention, in order to improve the convenience of connection between the upper frame 20 and the connecting piece 26', connection accuracy and reliability, a connecting rivet 267 is arranged in the middle of the two connecting plates of the connecting piece 26'. In this way, when the upper frame 20 and the connecting piece 26' are pre-fixed and welded, the two rivets 263, 265 for connecting the upper frame and the connecting piece 26', and the connecting rivets 267 between the two connecting plates of the connecting piece 26' form a stable three-point stable structure to avoid the problem that the welding quality is poor due to inaccurate alignment between the upper frame 20 and the connecting piece 26'. In addition, due to the existence of the three-point stable structure, the problem that the fixing structure of the upper frame 20 and the connecting piece 26' would be easily deformed during the long-time use of the seat can also be avoided to improve the stability and the strength of the seat. Based on the above, it is unnecessary for the upper frame and the connecting piece to be welded at the whole edge, alternatively, spot welding (for example, only two points need to be welded on a single side) can be adopted to ensure the strength and the stability of the structure. Similarly, for the fixing connection mechanism of the base left supporting tube and the base right supporting tube 18, 16 and the connecting piece 25', the same design is also made. A connecting rivet is also arranged in the middle of the two connecting plates of the connecting piece 25', and the description is not repeated herein.

The chair frame provided by the invention has very excellent load bearing strength and extremely high stability. A group of connecting structures of a clamping piece and a clamping pin are additionally arranged between each of two ends of the front driving tube and the upper frame. The clamping pin connecting structure, the upper frame, the base supporting tube, the connecting rod mechanism of the chair frame and the like are not arranged in the same plane, to form three-point fixed pressure-bearing structures in the space. When a user sits on the chair, the weight of the body can be transmitted to the base of the chair frame through the structure firstly, and the extra weight can be transmitted to a pressure bearing structure of the motor telescopic rod mechanism. The front portion and the rear portion of the clamping piece are respectively provided with a clamping portion so that a new pressure-bearing structure can be ensured to be formed in each state under the condition that the chair frame pedal support is stretched or retracted, or the seat is lifted. In this way, the weight bearing capability of the seat can be greatly improved, while the stability of the seat is also improved, and there is no problem even when the user uses the seat abnormally. In addition, the motor telescopic rod mechanism is effectively protected, to avoid the problems that the motor telescopic rod mechanism is prone to deformation and even fracture. The connecting structure between the upper frame and the fixed connecting piece thereof, and the connecting structures between the left and right supporting tubes of the chair frame and the fixed connecting pieces thereof are improved and designed, so that not only is the precision of welding fixation improved, but also the load bearing strength and stability of the connection structure are improved.

The present invention is not limited to above embodiments. Those skilled in the art can make modifications and changes without going beyond the spirit i.e., the scope of the present invention. Therefore, the scope of protection of the present invention depends on the scope defined in the claims.

I claim:

1. A chair frame with high strength and high stability, comprising:

a base, wherein the base includes a base front supporting tube, a base rear supporting tube, a base right supporting tube, and a base left supporting tube, a pedal support is connected to a front driving tube through a connecting rod mechanism, one end of a main motor telescopic rod mechanism is fixedly connected to the front driving tube, and the other end of the main motor telescopic rod mechanism is fixedly connected to the base rear supporting tube;

a left handrail support and a right handrail support are fixed to a left end of a backrest front driving tube and a right end of the backrest front driving tube, the backrest front driving tube is connected to the front driving tube through a connecting rod mechanism, one end of a backrest motor telescopic rod mechanism is fixedly connected to the backrest front driving tube, and the other end of the backrest motor telescopic rod mechanism is fixedly connected to a backrest rear driving tube;

a front end of an upper frame is connected to an upper portion of a first connecting piece, and a front end of a lower frame is connected to a lower portion of the first connecting piece through a first rivet, and a rear end of the lower frame is connected to a second connecting piece through a second rivet, a rear end of the base left supporting tube and a rear end of the base right supporting tube are connected to a lower portion of the second connecting piece, each of two sides of the front driving tube is further connected to a clamping piece, and a clamping pin structure matched with the clamping piece is fixed on the upper frame.

2. The chair frame with high strength and high stability of claim 1, wherein the clamping piece includes a square hole connected to the front driving tube in a sleeved mode, a first clamping portion, and a second clamping portion opposite to the first clamping portion, wherein the clamping pin structure includes a fixing portion fixed to the upper frame, and a pin shaft matched with the first clamping portion of the clamping piece.

3. The chair frame with high strength and high stability of claim 2, wherein the clamping piece is installed on the front driving tube through the square hole; and welded and fixed to the front driving tube.

4. The chair frame with high strength and high stability of claim 2, wherein the clamping pin structure further includes a limiting portion, and the pin shaft is arranged between the fixing portion and the limiting portion.

5. The chair frame with high strength and high stability of claim 1, wherein a point where the clamping piece connects to the clamping pin structure is not in the same plane as the connecting rod mechanism on two sides of the chair frame.

6. The chair frame with high strength and high stability of claim 1, wherein a clamping pin is arranged on the first connecting piece of the upper frame, after the pedal support of the chair frame is retracted, the second clamping portion of the clamping piece abuts against the clamping pin.

7. The chair frame with high strength and high stability of claim 1, wherein a first connecting rivet is arranged in the middle of two connecting plates of the first connecting piece of the upper frame, and the first connecting rivet is not in the same plane as the first rivet and the second rivet, and the first connecting rivet, the first rivet and the second rivet form a stable three-point structure.

8. The chair frame with high strength and high stability of claim 1, wherein a second connecting rivet is arranged in the middle of two connecting plates of the second connecting piece of the base left supporting tube and the base right supporting tube, and the second connecting rivet is not in the same plane as a third rivet and a fourth rivet, wherein the third rivet is connected between the second connecting piece and the base left supporting tube, and the fourth rivet is connected between the second connecting piece and the base right supporting tube.

9. The chair frame with high strength and high stability of claim 7, wherein the upper frame is fixed to the first connecting piece by spot welding.

10. The chair frame with high strength and high stability of claim 8, wherein the base left supporting tube or the base right supporting tube is fixed to the second connecting piece by spot welding.

11. The chair frame with high strength and high stability of claim 7, wherein a second connecting rivet is arranged in the middle of two connecting plates of the second connecting piece of the base left supporting tube and the base right supporting tube, and the second connecting rivet is not in the same plane as a third rivet and a fourth rivet, wherein the third rivet is connected between the second connecting piece and the base left supporting tube, and the fourth rivet is connected between the second connecting piece and the base right supporting tube.

12. The chair frame with high strength and high stability of claim 11, wherein the base left supporting tube or the base right supporting tube is fixed to the second connecting piece by spot welding.

* * * * *